US010214825B2

(12) United States Patent
Walker

(10) Patent No.: US 10,214,825 B2
(45) Date of Patent: Feb. 26, 2019

(54) METHOD OF DEPOSITING ONE OR MORE LAYERS OF MICROSPHERES TO FORM A THERMAL BARRIER COATING

(71) Applicant: GM Global Technology Operations LLC, Detroit, MI (US)

(72) Inventor: Michael J. Walker, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/394,214

(22) Filed: Dec. 29, 2016

(65) Prior Publication Data

US 2018/0185876 A1 Jul. 5, 2018

(51) Int. Cl.

| | |
|---|---|
| ***C23C 4/00*** | (2016.01) |
| ***C25D 7/00*** | (2006.01) |
| ***C23C 18/16*** | (2006.01) |
| ***C23C 10/00*** | (2006.01) |
| ***C25D 5/50*** | (2006.01) |

(52) U.S. Cl.

CPC ..... *C25D 7/008* (2013.01); *C23C 4/00* (2013.01); *C23C 10/00* (2013.01); *C23C 18/1635* (2013.01); *C25D 5/50* (2013.01); *C25D 7/00* (2013.01)

(58) Field of Classification Search

CPC ..... B05D 5/00; C25D 7/008
USPC ..... 427/376.1
See application file for complete search history.

(56) References Cited

U.S. PATENT DOCUMENTS

| | | | | |
|---|---|---|---|---|
| 4,775,598 | A * | 10/1988 | Jaeckel | B22F 1/0051 419/19 |
| 6,071,628 | A * | 6/2000 | Seals | C23C 28/00 428/610 |
| 6,916,529 | B2 * | 7/2005 | Pabla | C23C 4/02 416/241 R |
| 2007/0209317 | A1 * | 9/2007 | Jensen | B05D 7/14 52/834 |
| 2013/0156958 | A1 * | 6/2013 | Belov | C23C 24/08 427/372.2 |
| 2017/0234216 | A1 | 8/2017 | Durrett et al. | |
| 2017/0274456 | A1 | 9/2017 | Walker et al. | |
| 2018/0179623 | A1 | 6/2018 | Walker | |

FOREIGN PATENT DOCUMENTS

WO WO 2015/110379 * 7/2015

* cited by examiner

*Primary Examiner* — Tabatha L Penny
(74) *Attorney, Agent, or Firm* — Reising Ethington P.C.

(57) ABSTRACT

A method of forming a thermal barrier coating onto a surface of a ferrous alloy or nickel alloy component part involves depositing a layer of hollow microspheres to a surface of the component part or to a previously deposited layer of hollow microspheres through heating and cooling of a metallic precursor setting layer composed of copper, a copper alloy, or a nickel alloy. Once deposited in place, the layer(s) of hollow microspheres are heated to sinter the hollow microspheres to each other and to the surface of the ferrous alloy or nickel alloy component part to form an insulating layer.

19 Claims, 5 Drawing Sheets

METHOD OF DEPOSITING ONE OR MORE LAYERS OF MICROSPHERES TO FORM A THERMAL BARRIER COATING

TECHNICAL FIELD

The technical field of this disclosure relates generally to a thermal barrier coating that comprises an insulating layer having one or more layers of hollow microspheres and, more specifically, to methods of preparing the same.

BACKGROUND

Thermal barrier coatings are a class of insulating coatings designed for application to metal surfaces that operate at elevated temperatures. For example, in certain industries, such as the automotive industry, the advent of new materials and advanced thermomechanical systems along with an interest in exhaust heat management has created a need for certain metal component parts to be able to endure intense heat and thermal loading over a prolonged period of time. The internal combustion engine and the engine exhaust system are two notable systems within an automobile where thermal barrier coatings can be useful due to the temperatures associated with combusting an air/fuel mixture and the management of combustion byproducts. Thermal barrier coatings are theoretically well suited for these and other applications since they can effectively limit the thermal exposure of the underlying metal and prevent heat from escaping to the surrounding ambient environment, which can extend the life of the component part and improve system efficiencies. While a variety of thermal barrier coatings are already known, the pursuit of new thermal barrier coatings and related techniques for applying those coatings to simple and complex part surfaces is ongoing.

SUMMARY OF THE DISCLOSURE

A method of forming a thermal barrier coating on a metal component part according to one embodiment of the disclosure includes several steps. First, a metallic precursor setting layer is adhered onto a surface of a ferrous alloy or nickel alloy component part. The precursor setting layer is a layer of copper, a copper alloy, or a nickel alloy. Second, hollow microspheres are located against the component part so that the hollow microspheres contact the metallic precursor setting layer. The hollow microspheres have an outer layer of nickel, a nickel alloy, iron, or an iron alloy. Third, the metallic precursor setting layer is heated to a temperature above the liquidus temperature of the precursor setting layer to melt the precursor setting layer and wet a layer of hollow microspheres located adjacent to the surface of the component part. Fourth, the precursor setting layer is cooled to a temperature below the solidus temperature of the precursor setting layer to solidify the precursor setting layer and bond the layer of hollow microspheres to the surface of the component part. Fifth, the hollow microspheres that are not bonded by the metallic precursor setting layer are moved away from the component part. And sixth, the ferrous alloy or nickel alloy component part and the layer of hollow microspheres bonded to the surface of the component part are heated to sinter the hollow microspheres to each other and to the surface of the component part such that a solid state joint is formed between the layer of hollow microspheres and the surface of the ferrous alloy or nickel alloy component part.

The hollow microspheres, the metallic precursor setting layer, and the ferrous alloy or nickel alloy component part may be further defined. The hollow microspheres may be constructed in a variety of ways to support their outer layer of nickel, a nickel alloy, iron, or an iron alloy. In one embodiment, for example, at least some of the hollow microspheres include a hollow glass base wall coated externally with a layer of nickel, a nickel alloy, iron, or an iron alloy. In another embodiment, at least some of the hollow microspheres include a hollow polymeric base wall coated externally with a layer of nickel, a nickel alloy, iron, or an iron alloy. And, in still another embodiment, at least some of the hollow microspheres include a hollow ceramic base wall coated externally with a layer of nickel, a nickel alloy, iron, or an iron alloy. Moreover, the ferrous alloy or nickel alloy component part may be an engine piston, an intake valve, an exhaust valve, an engine block, an engine head, an exhaust gas pipe, or a turbocharger housing, to name but a few examples, and the metallic precursor setting layer may be adhered in place to a thickness that ranges from 0.1 μm to 20 μm.

The several steps of the disclosed method for forming the thermal barrier coating may be performed in certain preferred ways. To be sure, the ferrous alloy or nickel alloy component part and the layer of hollow microspheres bonded to the surface of the component part may be heated to sinter those entities together and thereby form the solid state joint by heating the microspheres and the component part to a temperature below the solidus temperature of the precursor setting layer for a period of time at least until the metallic precursor setting layer dissolves into the outer layer of the hollow microspheres and the ferrous alloy or nickel alloy component part. For example, if the precursor setting layer is copper, the solidus and liquidus temperature of the metallic precursor setting layer is the melting temperature of copper or 1085° C. In that regard, heating the metallic precursor setting layer to above the liquidus temperature comprises heating the metallic precursor setting layer to above 1085° C., cooling the metallic precursor setting layer to below the solidus temperature comprises cooling the metallic precursor setting layer to below 1085° C., and an option for heating the ferrous alloy or nickel alloy component part and the layer of hollow microspheres to sinter the hollow microspheres to each other and to the surface of the component part would be to heat the layer of hollow microspheres and the component part to a temperature in the range of 800° C. and 1085° C.

Prior to heating the ferrous alloy or nickel alloy component part and the hollow microspheres to sinter the hollow microspheres to each other and to the surface of the component part, additional layers of hollow microspheres may be deposited on top of the first initially deposited layer. To deposit a second layer of hollow microspheres, the method of forming a thermal barrier coating may further include adhering a second metallic precursor setting layer onto the layer of hollow microspheres bonded to the surface of the ferrous alloy or nickel alloy component part. The metallic precursor setting layer may again be a layer of copper, a copper alloy, or a nickel alloy. Next, hollow microspheres are located against the component part so that the hollow microspheres contact the second metallic precursor setting layer overlying the layer of hollow microspheres bonded to the surface of the component part. The hollow microspheres have an outer layer of nickel, a nickel alloy, iron, or an iron alloy. The second metallic precursor setting layer is then heated to a temperature above its liquidus temperature to melt the second metallic precursor setting layer and wet a second layer of hollow microspheres located adjacent to the layer of hollow microspheres bonded to the surface of the component part, followed by cooling the second metallic precursor setting layer to a temperature below its solidus temperature to solidify the second metallic precursor setting layer and bond the second layer of hollow microspheres to the layer of hollow microspheres bonded to the surface of the component part. Any hollow microspheres that are not bonded to the second metallic precursor setting layer are eventually moved away from the component part.

More than one additional layer of hollow microspheres may be deposited on top of the first initially deposited layer. Indeed, the additional steps recited above with regard to depositing the second layer of hollow microspheres may be repeated as many times as desired to sequentially deposit additional layers of hollow microspheres on top of the second layer of hollow microspheres. Once all the layers of the hollow microspheres are deposited, the heating of the ferrous alloy or nickel alloy component part and the layer of hollow microspheres to sinter the hollow microspheres to each other and to the surface of the ferrous alloy or nickel alloy component part includes sintering all of the sequentially applied layers of hollow microspheres together and to the surface of the ferrous alloy or nickel alloy component part.

A method of forming a thermal barrier coating on a metal component part according to another embodiment of the disclosure includes several steps. First, one or more layers of hollow microspheres are deposited onto a surface of a ferrous alloy or nickel alloy component part. The hollow microspheres of each of the one or more layers have an outer layer of nickel, a nickel alloy, iron, or an iron alloy, and each of the one or more layers of hollow microspheres is bonded to either the surface of the ferrous alloy or nickel alloy component part or to a previously deposited layer of hollow microspheres by a metallic precursor setting layer of copper, a copper alloy, or a nickel alloy. Second, the one or more layers of hollow microspheres and the ferrous alloy or nickel alloy component part are heated to sinter the hollow microspheres to each other and to the surface of the component part to thereby produce an insulating layer. And third, a gas-impermeable sealing layer is applied over the insulating layer to form a thermal barrier coating over the surface of the ferrous alloy or nickel alloy component part.

Depositing a first layer of hollow microspheres onto the surface of the ferrous alloy or nickel alloy component part may include adhering a metallic precursor setting layer onto the surface of the ferrous alloy or nickel alloy component part followed by placing hollow microspheres in contact with metallic precursor setting layer, heating the metallic precursor setting layer to a temperature above its liquidus temperature to melt the metallic precursor setting layer and wet a layer of hollow microspheres, cooling the metallic precursor setting layer to a temperature below its solidus temperature to solidify the metallic precursor setting layer and bond the layer of hollow microspheres to the surface of the component part, and moving hollow microspheres that are not bonded to the metallic precursor setting layer away from the component part. Only this first layer of hollow microspheres may be deposited or, alternatively, additional layers of hollow microspheres may be deposited on top of the first layer.

Similarly, depositing each additional layer of hollow microspheres onto the surface of the ferrous alloy or nickel alloy component part may include adhering another metallic precursor setting layer onto a previously deposited layer of hollow microspheres, placing hollow microspheres in contact with the another metallic precursor setting layer, heating the another metallic precursor setting layer to a temperature above its liquidus temperature to melt the another precursor setting layer and wet another layer of hollow microspheres located adjacent to the previously deposited layer of hollow microspheres, cooling the another metallic precursor setting layer to a temperature below its solidus temperature to solidify the another precursor setting layer and bond the another layer of hollow microspheres to the previously deposited layer of hollow microspheres, and moving hollow microspheres that are not bonded to the another metallic precursor setting layer away from the component part The hollow microspheres, the insulating layer formed from the deposited layers of hollow microspheres, and the gas-impermeable sealing layer may be further defined. For example, the hollow microspheres in each of the one or more layers of hollow microspheres may comprise (1) glass base walls coated externally with a layer of nickel, a nickel alloy, iron, or an iron alloy, (2) polymeric base walls coated externally with a layer of nickel, a nickel alloy, iron, or an iron alloy, or (3) ceramic base walls coated externally with a layer of nickel, a nickel alloy, iron, or an iron alloy. Furthermore, regarding the insulating layer, it may have a thickness that ranges from 5 μm to 5 mm depending on the size of the hollow microspheres and the number of layers of hollow microspheres deposited onto the surface of the component part. The gas-impermeable sealing layer applied over the insulating layer may be composed of nickel, stainless steel, a nickel-based superalloy, vanadium, molybdenum, or titanium.

In some implementations of the method of forming a thermal barrier coating, the metallic precursor setting layer that bonds each layer of hollow microspheres to either the surface of the ferrous alloy or nickel alloy component part or to a previously applied layer of hollow microspheres is composed of copper. The liquidus and solidus temperatures of copper are the same—i.e., 1085° C. Accordingly, when each of the metallic precursor setting layer is composed of copper, an option for heating the ferrous alloy or nickel alloy component part and the one or more layers of hollow microspheres to sinter the hollow microspheres to each other and to the surface of the ferrous alloy or nickel alloy component part would be to heat the component part and the one or more layers of hollow microspheres to a temperature in the range of 800° C. and 1085° C.

DETAILED DESCRIPTION

Thermal barrier coatings are useful in a wide range of applications where protection of the underlying metal from elevated temperatures and/or insulation against heat loss to the surrounding ambient environment is desired. In the present disclosure, a thermal barrier coating is described that includes an insulating layer comprised of one or more layers of hollow microspheres that are sintered to each other and to a surface of a ferrous alloy or nickel alloy component part. The hollow microspheres and the surface of the ferrous alloy or nickel alloy component part are sintered in the sense that they are metallurgically joined together by a solid state joint that results from the dissolution of a metallic precursor setting layer that originally bonds each layer of hollow microspheres in place. Due to the relatively high void volume associated with the hollow microspheres in the aggregate, the insulating layer exhibits a low thermal conductivity and a low heat capacity, which obstructs heat transfer through the insulating layer and thus the thermal barrier coating as a whole while allowing surface temperatures of the thermal barrier coating to readily fluctuate or swing in response to changes to its exposed thermal environment.

Figure 1:
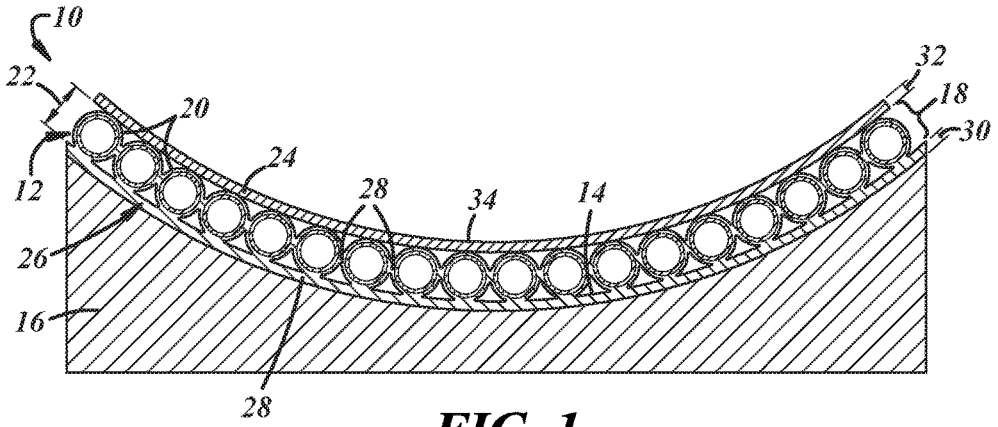
FIG. 1 is an idealized cross-sectional view of a thermal barrier coating formed on and covering a ferrous alloy or nickel alloy component part according to one embodiment of the disclosure.
Figure 2:
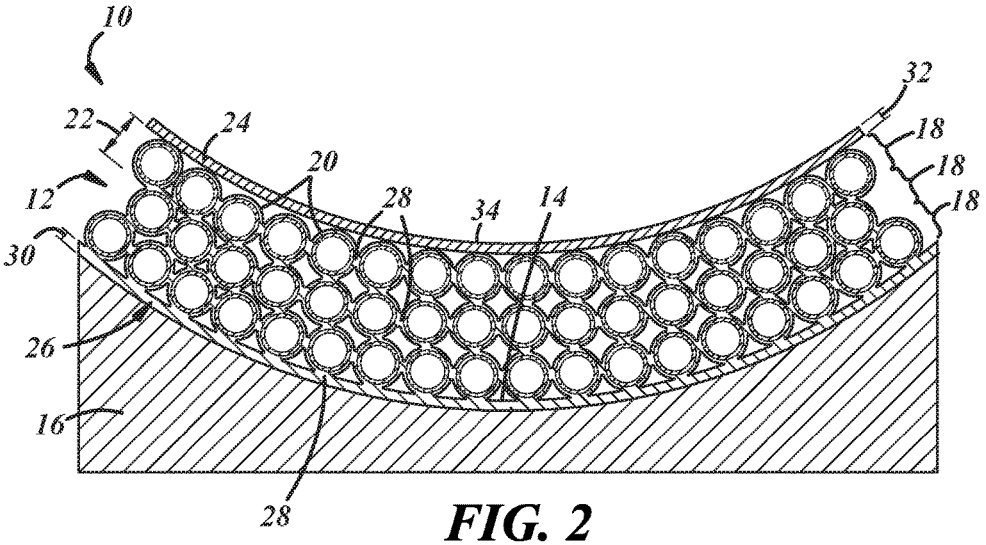
FIG. 2 is an idealized cross-sectional view of a thermal barrier coating formed on and covering a ferrous alloy or nickel alloy component part according to another embodiment of the disclosure.

FIGS. 1-2 illustrate in idealized fashion a thermal barrier coating 10 that includes an insulating layer 12 according to the present disclosure. Referring for the moment to FIG. 1, the thermal barrier coating 10 as a whole is formed onto and covers a surface 14 of a ferrous alloy or nickel alloy component part 16. The insulating layer 12 includes one or more layers 18 of hollow microspheres 20. Each of those layers 18 has a thickness 22 across its length and width of approximately a single microsphere. This thickness 22 may or may not vary to some degree depending on the variability of the sizes of the microspheres 20 relative to one another. As shown here in FIG. 1, the insulating layer 12 may be a single layer 18 of hollow microspheres 20. Or, in another embodiment, the insulating layer 12 may be comprised of multiple layers 18 of hollow microspheres 20 stacked sequentially on top of each other. As many as fifty layers 18 of hollow microspheres 20 may be stacked together to form the insulating layer 12. The thermal barrier coating 10 also includes a gas-impermeable sealing layer 24 applied over the insulating layer 12.

The ferrous alloy or nickel alloy component part 16 may be any of a wide variety objects that are subjected to aggressive thermal environments including, but not limited to, a piston, an intake or exhaust valve, an exhaust gas manifold, an engine block, an engine head, exhaust gas piping, a turbocharger housing, or a gas turbine or aero-engine part blade, to name but a few specific examples. In the context of an automobile, the ferrous alloy or nickel alloy component part 16 is typically a vehicle component in which the thermal barrier coating 10 that covers the surface 14 is exposed to combustion gas products that can have temperatures as high as 1800° C. depending on the type of engine (e.g., gasoline, diesel, etc.) and the composition of the combustible air/fuel mixture (e.g., rich, lean, or stoichiometric). Of course, the thermal barrier coating 10 may be applied to a diverse array of component parts designed for other applications besides automobile applications. Several examples of common ferrous alloys and nickel alloys that may constitute the component part 16 are 430F, 304, and 303 stainless steel, M2 and M50 high speed steel, cast iron (such as a diesel head), Inconel (i.e., a family of nickel-chromium-based superalloys), Hastelloy (a family of nickel-based superalloys), and other superalloys.

Each of the one or more layers 18 of hollow microspheres 20 includes microspheres 20 that are spread out in a length and width direction to cover a designated area of the surface 14 of the ferrous alloy or nickel alloy component part 16. The thickness 22 of each layer 18 of hollow microspheres 20 may range from 5 μm to 250 μm or, more narrowly, from 20 μm to 40 μm, depending on the diameter of the individual microspheres 20 included in that layer 18, and the overall thickness of the insulating layer 12 may accordingly range from 5 μm to 5 mm. The microspheres 20 are sintered to one another as well as to the surface 14 of the ferrous alloy or nickel alloy component part 16 by way of a solid state joint 26. In particular, the hollow microspheres 20 may be sintered directly to the surface 14 of the ferrous alloy or nickel alloy component part 16, which is the case for the layer 18 of microspheres 20 located immediately adjacent to that surface 14, or they may be indirectly sintered to the surface 14 through other intervening layers 18 of sintered hollow microspheres 20.

The solid state joint 26 joint that typifies the sintered state of the hollow microspheres 20 and the ferrous alloy or nickel alloy component part 16 is born from the dissolution of a metallic precursor setting layer into the microspheres 20 themselves as well as the ferrous alloy or nickel alloy component part 16. The precursor setting layer may be comprised of copper, a copper alloy, or a nickel alloy (described in more detail below). As such, an alloy 28 interconnects the microspheres 20 and infiltrates into the ferrous alloy or nickel alloy component part 16 a distance 30 of up to 1 mm from the surface 14. The alloy system 28 includes nickel and a maximum of 50 wt % copper along with other potential elements, such as zinc and/or tin, when disposed about only the microspheres 20, and may additionally include elements from the ferrous alloy or nickel alloy component part 16 in the portion of the joint 26 that extends the distance 30 into the component part 16. The solid state joint 26 thus includes two portions that compositionally may be the same or may differ from one another while still being part of an incessant alloy system.

The gas-impermeable sealing layer 24 is a high-melting temperature thin film layer or layers that covers and seals the insulating layer 12 against exposure to hot gasses. The sealing layer 24 has a thickness 32 that typically ranges from 1 μm to 20 μm or, more narrowly, from 1 μm to 5 μm, and provides an outer surface 34 of the thermal barrier coating 10. The outer surface 34 may be smooth. Having a smooth outer surface 34 may be desirable in some instances to prevent the creation of turbulent gas flow over the thermal barrier coating 10 while helping ensure that the heat transfer coefficient of the sealing layer 24 remains as low as possible. The material of the sealing layer 24 is selected so that the layer 24 can tolerate harsh thermal conditions yet be resilient enough to resist fracturing or cracking and to withstand thermal expansion/contraction relative to the underlying insulating layer 12. Some notable examples of materials that are suitable for the sealing layer 24 include nickel, stainless steel, nickel-based superalloys (e.g., Inconel, Hastelloy, etc.), vanadium, molybdenum, and titanium. The sealing layer 24 is preferably applied to the insulating layer 12 by way of any known thin-film deposition technique including, for example, electroplating and physical or chemical vapor deposition.

A method of forming the thermal barrier coating 10 is illustrated in FIGS. 4-11 and described in further detail below. The disclosed method calls for depositing one or more layers 36 of hollow microspheres 38 (FIGS. 8 and 10) onto the surface 14 of a ferrous alloy or nickel alloy component part 16 using a metallic precursor setting layer 40 to bond each of the layers 36 to either the surface 14 of the ferrous alloy or nickel alloy component part 16 (first deposited layer) or to a previously deposited layer 36 of hollow microspheres 38 (each additional deposited layer). The hollow microspheres 38 include an outer layer of nickel, a nickel alloy, iron, or an iron alloy. Once deposited, the layer(s) 36 of hollow microspheres 38 and the ferrous alloy or nickel alloy component part 16 are heated to sinter the hollow microspheres 38 to each other and to the surface 14 of the ferrous alloy or nickel alloy component part 16 to thereby produce the insulating layer 12. The sintering process causes the precursor setting layer(s) 40 to dissolve into the outer layers of the hollow microspheres 38 and the ferrous alloy or nickel alloy component part 16 to form the solid state joint 26. Eventually, after the insulating layer 12 is formed, the gas-impermeable sealing layer 24 is applied over the insulating layer 12 to form the thermal barrier coating 10.

Figure 3:
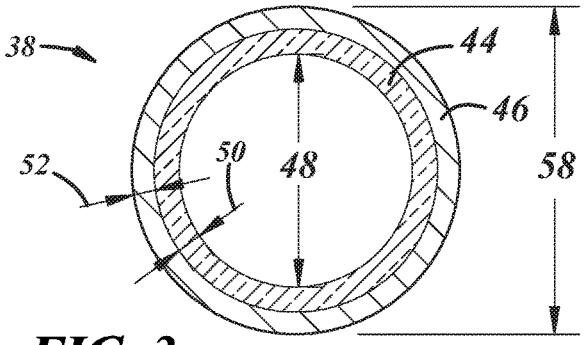
FIG. 3 is a cross-sectional view of one of the hollow microspheres that is located onto the ferrous alloy or nickel alloy component part during deposition of a layer of hollow microspheres using the metallic precursor setting layer as illustrated in FIGS. 6-8.

A representative depiction of each of the hollow microspheres 38 employed in the method set forth in FIGS. 4-11 is shown in FIG. 3. As can be seen, the hollow microsphere 38 includes a base wall 44 coated externally with an outer layer 46 of nickel, a nickel alloy, iron, or an iron alloy. In preferred embodiments, the outer layer 46 is composed of nickel or Hastelloy (e.g., Hastelloy B, B2, C, C4, C276, F, G, or G2). The base wall 44 is preferably comprised of glass, a polymer such as an acrylonitrile copolymer (e.g., styrene-acrylonitrile copolymer), or a ceramic such as $Al_2O_3$—$SiO_2$ as contained in the commercial product Fillite, which is available from Tolsa USA, Inc. (Reno, Nev.), as well other materials not specifically mentioned. The outer layer 46 may be externally coated onto the base wall 44 by electroplating, flame spraying, painting, electroless plating, physical or chemical vapor deposition, or some other suitable technique. The base wall 44 may have an inner diameter 48 that ranges from 5 μm to 200 μm or, more narrowly, ranges from 20 μm to 60 μm, and may further have a thickness 50 that ranges from 0.1 μm to 5 μm or, more narrowly, ranges from 0.5 μm to 2 μm. The outer layer 46 of nickel, a nickel alloy, iron, or an iron alloy may have a thickness 52 that ranges from 0.1 μm to 5 μm or, more narrowly, ranges from 0.5 μm to 2 μm. Taking the size and thickness of the base wall 44 as well as the thickness 52 of the surrounding outer layer 46 into account, each of the hollow microspheres 38 may have a diameter 58 that ranges from 5 μm to 210 μm or, more narrowly, that ranges from 30 μm to 60 μm.

Figure 4:
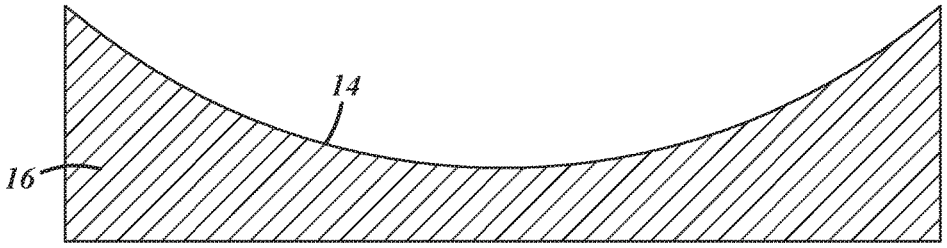
FIG. 4 depicts a ferrous alloy or nickel alloy component part prior to forming a thermal barrier coating over a surface of the component part.

Referring now to FIG. 4, the method of forming the thermal barrier coating 10 involves providing the ferrous alloy or nickel alloy component part 16 with its surface 14 prepared for formation of the thermal barrier coating 10. The surface 14 can be broad and cover all or substantially all of the ferrous alloy or nickel alloy component part 16 or it may be only a targeted portion of the component part 16. Additionally, the surface 14 may have a simple or complex profile. For instance, as indicated above, the surface 14 may be any surface of a piston that operates within an internal combustion engine, any surface of an intake valve or an exhaust valve that cycles to open and close the intake and exhaust ports in the cylinder head of an internal combustion engine, respectively, any surface of the cylinder head such as the combustion dome area, any surface of an exhaust gas manifold, any surface an engine block including the surface that defines an engine cylinder, any surface of the exhaust gas piping that routes exhaust gas produced by an internal combustion engine from the exhaust gas manifold through the vehicle tailpipe, any surface of a turbocharger housing, or any surface of a gas turbine or aero-engine part blade. The most common surfaces of these and other component parts that may be covered by the thermal barrier coating 10 are those surfaces that are exposed to hot combustion gas products on a regular basis.

Figure 5:
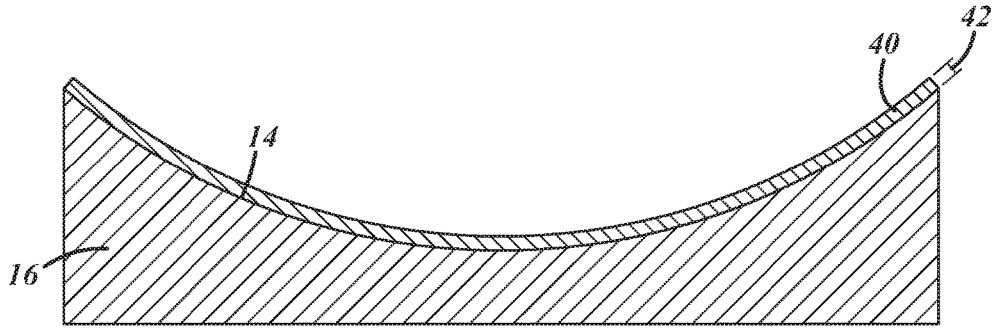
FIG. 5 depicts the ferrous alloy or nickel alloy component part with a metallic precursor setting layer adhered to the surface of the component part.

An initial or first layer 36 of hollow microspheres 38 is deposited onto the surface 14 of the ferrous alloy or nickel alloy component part 16 using the metallic precursor setting layer 40. As shown in FIG. 5, the metallic precursor setting layer 40 is adhered onto the surface 14 of the ferrous alloy or nickel alloy component part 16 by any suitable technique. The metallic precursor setting layer 40 may be (1) copper, (2) a copper alloy, or (3) a nickel alloy. The copper alloy preferably includes at least 70 wt % copper and may further include other alloy constituents such as zinc, tin, or a combination of zinc and tin. The nickel alloy preferably includes at least 70 wt % nickel and may further include other alloy constituents such as zinc, tin, copper, or a combination of any two or all three of the aforementioned alloy constituents. Each of the copper and nickel alloys may include other minor alloy constituents not specifically listed.

Figure 12:
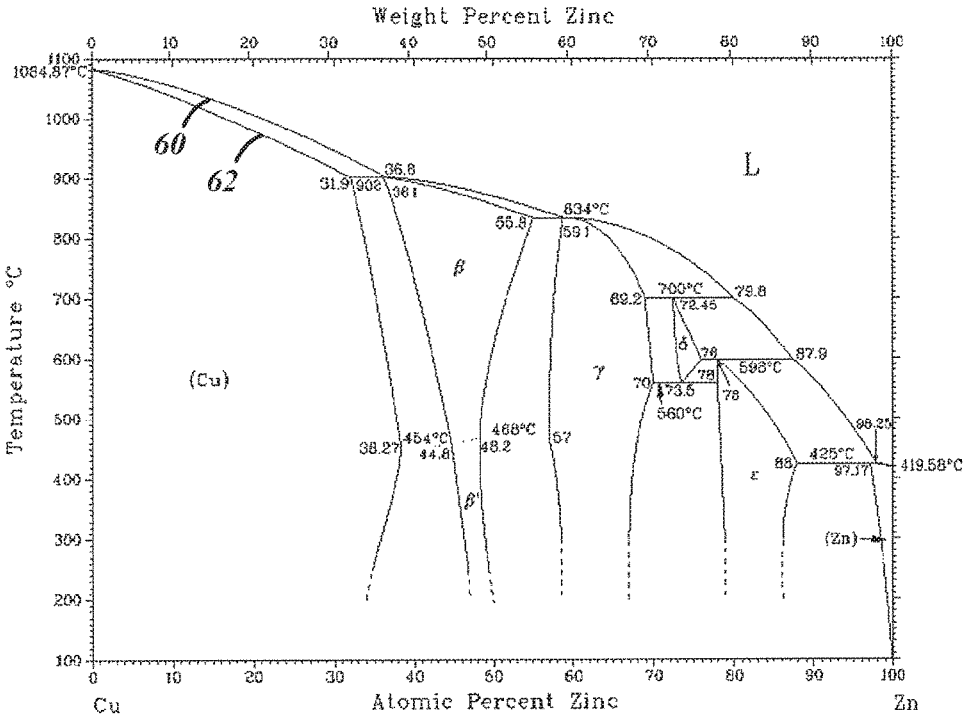
FIG. 12 is a copper-zinc phase diagram with temperature in degrees Celsius (° C.) on the left y-axis, weight percent zinc on the upper x-axis, and atomic percent zinc on the lower x-axis.

The metallic precursor setting layer 40 is preferably copper or a copper-zinc alloy. When composed of copper, the metallic precursor setting layer 40 constitutes "commercially pure copper," such as any of the unalloyed copper grades C10100 to C13000, which typically include at least 99.9 wt % copper along with nominal amounts of industry accepted impurities. When composed of a copper-zinc alloy, the metallic precursor setting layer 40 constitutes a binary copper-zinc alloy system, along with nominal amounts of industry accepted impurities, such that its phase behavior is represented by the phase diagram shown in FIG. 12. These particular examples of the metallic precursor setting layer 40 may be adhered to the surface 14 of the ferrous alloy or nickel alloy component part 16 by electroplating or physical or chemical vapor deposition and may have a thickness 42 in the range of 0.1 μm to 20 μm or, more narrowly, in the range of 0.5 μm to 5 μm, while preferably being no greater than one-half the average diameter of the hollow microspheres 38 being used. The same adhering techniques and thicknesses are also applicable when the metallic precursor layer 40 is composed of any of the other copper alloys or nickel alloys mentioned above.

Figure 6:
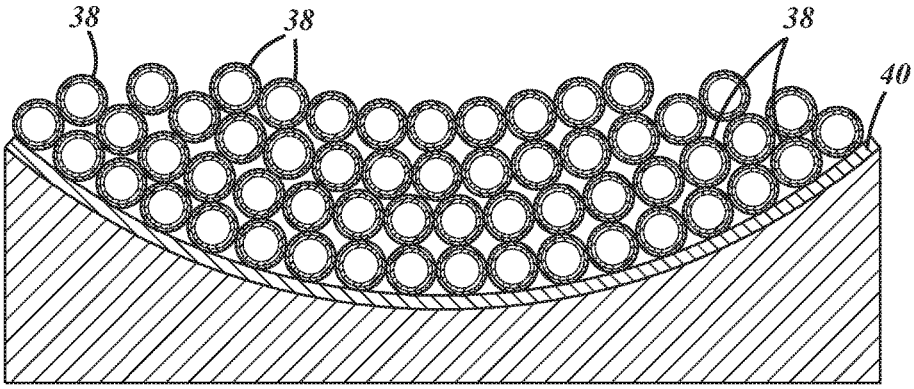
FIG. 6 depicts hollow microspheres being located onto the ferrous alloy or nickel alloy component part such that the hollow microspheres are in contact with the metallic precursor setting layer.

After the metallic precursor setting layer 40 is adhered in place, a contingent of the hollow microspheres 38 is located against the ferrous alloy or nickel alloy component part 16 such that the hollow microspheres 38 contact the precursor setting layer 40, as shown in FIG. 6. The amount of the hollow microspheres 38 located against the ferrous alloy or nickel alloy component part 16 may be sufficient to dispose an aggregate of the hollow microspheres 38 that is several times thicker—e.g., two to thousands of times thicker—than the average diameter of the individual microspheres 38 located against the ferrous alloy or nickel alloy component part 16. The surface 14 of the ferrous alloy or nickel alloy component part 16 plus the overlying metallic precursor setting layer 40 may have a profile that suffices to hold the hollow microspheres 38 in place such as the depressed surface profile shown here in FIG. 6. The hollow microspheres 38 can also be supported in place against the ferrous alloy or nickel alloy component part 16. Such supporting measures may involve placing the component part 16 in a mold cavity or other similar structure that is slightly larger than the component part itself 16 such that the hollow microspheres 38 can be loaded into and be retained in the space surrounding the component part 16. As another option, the ferrous alloy or nickel alloy component part 16 may be submerged into a bath of the hollow microspheres 38 along with a plurality of other parts as part of a batch processing operation.

Figure 7:
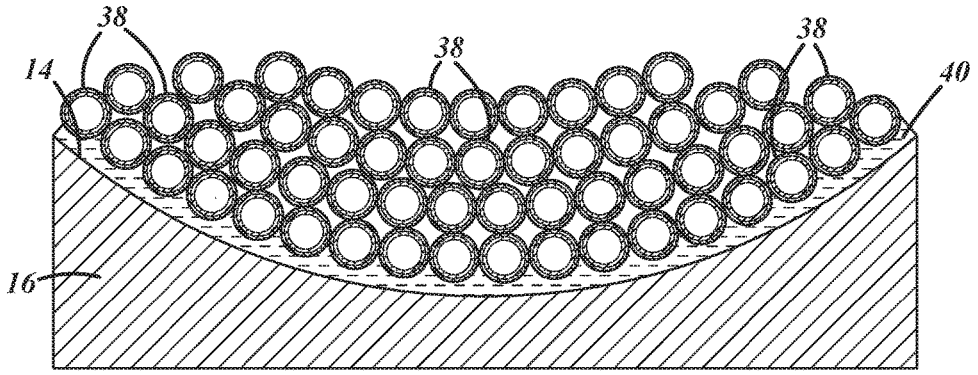
FIG. 7 depicts the metallic precursor setting layer in a melted state and wetting a layer of hollow microspheres located adjacent to the surface of the ferrous alloy or nickel alloy component part.

The metallic precursor setting layer 40 is then heated to a temperature above its liquidus temperature to melt the metallic precursor setting layer 40, as shown in FIG. 7. The liquidus temperature of the precursor setting layer 40 depends on the composition of the layer 40. For example, in the copper-zinc phase diagram shown in FIG. 12, the liquidus temperature is represented by reference numeral 60. As can be seen, if the metallic precursor setting layer 40 is copper, the liquidus temperature 60 of the setting layer 40 is equal to the melting point of copper, or 1085° C. And if the metallic precursor setting layer 40 is a copper-zinc alloy, the liquidus temperature 60 of the setting layer 40 falls gradually as the weight percent of zinc in the alloy increases. To be sure, the phase diagram shown in FIG. 12 indicates that a copper-zinc alloy that includes 30 wt % zinc and the balance copper has a liquidus temperature of about 950° C. When the metallic precursor setting layer 40 is in a melted or liquefied state, it wets a layer 36 of the hollow microspheres 38 located adjacent to the surface 14 of the ferrous alloy or nickel alloy component part 16. Such wetting of the hollow microspheres 38 establishes light adhesion amongst the hollow microspheres 38 and the surface 14 of the ferrous alloy or nickel alloy component part 16. The precursor setting layer 40 may be maintained in a melted state for a period of a few seconds to several minutes in order to adequately wet the layer 36 of hollow microspheres 38.

Figure 8:
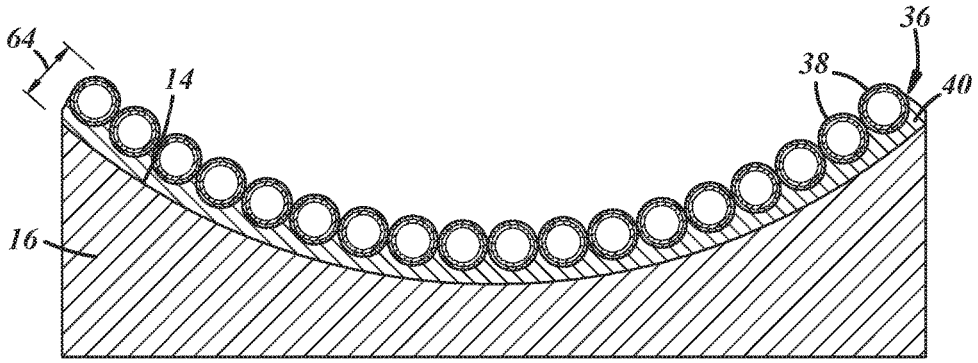
FIG. 8 depicts the metallic precursor setting layer in a solidified state and bonding a layer of hollow microspheres to the surface of the ferrous alloy or nickel alloy component part after the non-bonded hollow microspheres have been moved away from the component part.

Once the layer 36 of hollow microspheres 38 is sufficiently wetted, the metallic precursor setting layer 40 is cooled to a temperature below its solidus temperature to solidify the metallic precursor setting layer 40 from its previous melted or liquefied state, as shown in FIG. 8. Like the liquidus temperature, the solidus temperature of the precursor setting layer 40 depends on the composition of the layer 40. Referring again to the copper-zinc phase diagram shown in FIG. 12, the solidus temperature is represented by reference numeral 62. In that regard, if the metallic precursor setting layer 40 is copper, the solidus temperature 62 of the setting layer 40 is equal to the melting temperature of copper, or 1085° C., and is thus the same as the liquidus temperature. And if the metallic precursor setting layer 40 is a copper-zinc alloy, the solidus temperature 62 of the setting layer 40 falls gradually as the weight percent of zinc in the alloy increases. To be sure, the phase diagram shown in FIG. 12 indicates that a copper-zinc alloy that includes 30 wt % zinc and the balance copper has a solidus temperature of about 920° C. When the metallic precursor setting layer 40 is cooled from its melted or liquefied state to a solidified state, it bonds the layer 36 of hollow microspheres 38 to the surface 14 of the ferrous alloy or nickel alloy component part 16. The rest of the contingent of hollow microspheres 38 present on top of the bonded layer 36 of hollow microspheres 38 are, consequently, not bonded to the component part 16 by the metallic precursor setting layer 40.

The extra, non-bonded hollow microspheres 38 are moved away from the ferrous alloy or nickel alloy component part 16 following solidification of the metallic precursor setting layer 40. The non-bonded hollow microspheres 38 may be moved away by dumping them off of the surface 14, shaking the ferrous alloy or nickel alloy component part 16, removing the component part 16 from a mold cavity or bath that supported the contingent of hollow microspheres 38 against the component part 16, or any other appropriate technique for separating the non-bonded hollow microspheres 38 from the component part 16. Moving the non-bonded hollow microspheres 38 away from the ferrous alloy or nickel alloy component part 16 leaves behind the layer 36 of hollow microspheres 38 that is bonded to the surface 14 of the component part 16. This remaining bonded layer 36 is shown in FIG. 8. And, similar to the layer 18 of hollow microspheres 20 that it ultimately becomes, the bonded layer 36 of hollow microspheres 38 has a thickness 64 across its length and width that is approximate to a single microsphere 38 although such thickness 64 may vary depending on the variability in the sizes of the microspheres 38; that is, the thickness 64 of the bonded layer 36 at any point is approximately equal to the diameter 58 of the hollow microsphere 38 at that location.

Figure 9:
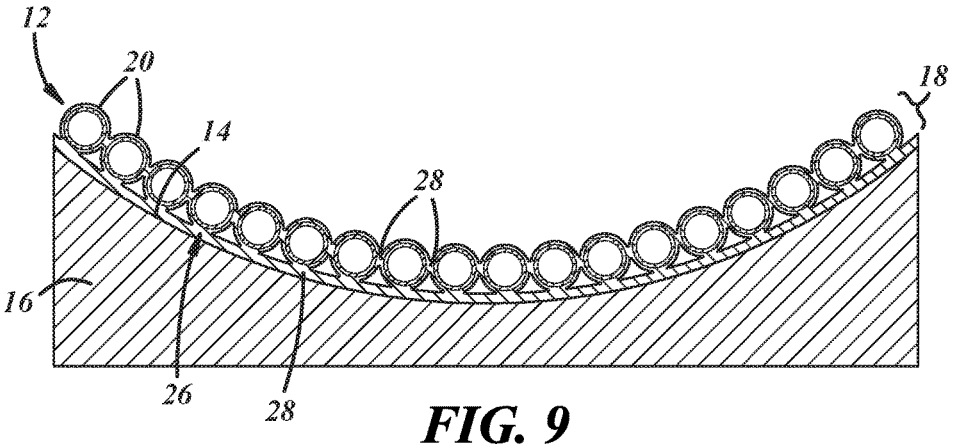
FIG. 9 depicts the layer of hollow microspheres from FIG. 8 in which the hollow microspheres have been sintered to each other and to the surface of the ferrous alloy or nickel alloy component part to form a solid state joint according to one embodiment of the disclosure.

The melting and solidifying of the metallic precursor setting layer 40 in the presence of the contingent of hollow microspheres 38 thus functions to deposit the layer 36 of hollow microspheres 38 onto the surface 14 of the ferrous alloy or nickel alloy component part 16. Following deposition of the layer 36 of hollow microspheres 38, the ferrous alloy or nickel alloy component part 16 and the layer 36 of hollow microspheres 38 are heated to sinter the hollow microspheres 38 to each other and to the surface 14 of the component part 16, as shown in FIG. 9. This may involve heating the layer 36 of hollow microspheres 38 and the component part 16 to a temperature below the solidus temperature of the metallic precursor setting layer 40 (now solidified) for a period of time at least until the metallic precursor setting layer 40 integrates and dissolves into the outer layers 46 of the hollow microspheres 38 and the ferrous alloy or nickel alloy component part 16 by way of solid-state particle diffusion. For example, when the metallic precursor setting layer 40 is copper, the layer 36 of hollow microspheres 38 and the component part 16 are preferably heated to within the temperature range of 800° C. to 1085° C. for a period of time ranging from 30 minutes to 24 hours. After all of the copper has been dissolved, the temperature associated with this particular heating process is no longer required to be held below the solidus temperature 62 of the metallic precursor setting layer 40.

The sintering that occurs from the dissolution of the precursor setting layer 40 into the outer layer 46 of the hollow microspheres 38 and the ferrous alloy or nickel alloy of the component part 16 fuses those entities together and forms the solid state joint 26 shown in FIG. 1 and discussed above. There are several ways to effectuate such sintering. For example, in one embodiment, the layer 36 of hollow microspheres 38 and the component part 16 may be heated in an oven or furnace without any other materials being present. Alternatively, in another embodiment, a layer of ceramic particles may be disposed over top of the layer 36 of hollow microspheres 38 to support the layer 36 against the ferrous alloy or nickel alloy component part 16. Other supporting materials besides ceramic particles may also be disposed over the layer 36 of hollow microspheres 38 so long as the supporting material chosen can withstand the requisite sintering temperatures without reacting with the hollow microspheres 38 or otherwise interfering with the dissolution of the precursor setting layer 40 into the outer layer 46 of the hollow microspheres 38.

The discussion above with regards to FIGS. 4-9 is focused on depositing a single layer 36 of hollow microspheres 38 onto the surface 14 of the ferrous alloy or nickel alloy component part 16 and then sintering that layer 36 to provide the insulating layer 12 with a single layer 18 of hollow microspheres 20 fused together by the solid state joint 26, as depicted in FIG. 1. A variation of that methodology can readily be implemented to provide the insulating layer 12 with multiple stacked layers 18 of hollow microspheres 20 fused together by the solid state joint 26, as depicted in FIG. 2. To be sure, as will be briefly discussed below, the process steps shown in FIGS. 5-8 can be repeated after the first layer 36 of hollow microspheres 38 is deposited onto the surface 14 of the ferrous alloy or nickel alloy component part 16, but before sintering, in order to deposit a corresponding number of additional layers 36 of hollow microspheres 38 on top of the first layer 36. Then, after all of the additional layers 36 of hollow microspheres 38 have been deposited, the group of layers 36 is heated and sintered together by the process step shown in FIG. 9 to produce the insulating layer 12.

Figure 10:
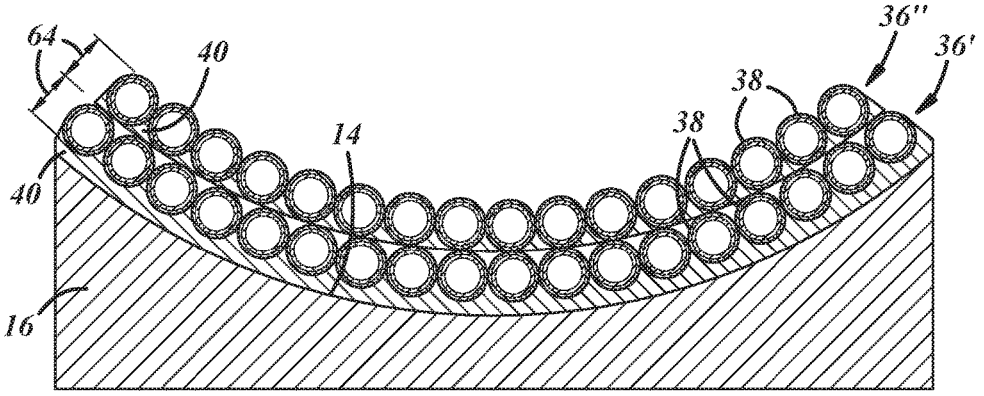
FIG. 10 depicts a first metallic precursor setting layer in a solidified state and bonding a first layer of hollow microspheres to the surface of the ferrous alloy or nickel alloy component part and, in addition, a second metallic precursor setting layer in a solidified state and bonding a second layer of hollow microspheres to the previously applied first layer of hollow microspheres, with all non-bonded hollow microspheres having been moved away from the component part.
Figure 11:
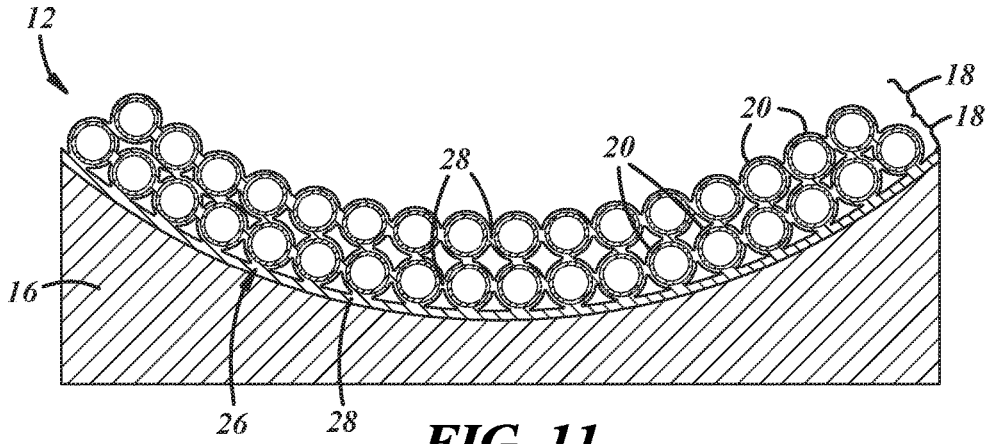
FIG. 11 depicts the layers of hollow microspheres from FIG. 10 in which the hollow microspheres have been sintered to each other and to the surface of the ferrous alloy or nickel alloy component part by a solid state joint according to one embodiment of the disclosure.

An example of how to form an insulating layer 12 having multiple stacked layers 18 of hollow microspheres 20 is represented in FIGS. 10-11. First, as described above with respect to FIGS. 4-9, a first layer 36 of hollow microspheres 38 is deposited onto the surface 14 of the ferrous alloy or nickel alloy component part 16. This first layer is identified more specifically in FIG. 10 by reference numeral 36'. Next, as shown in FIG. 10, a second layer 36" of hollow microspheres 38 is deposited onto the first layer 36' of hollow microspheres 38 in the same manner as described above. The deposition of the second layer 36", more specifically, involves adhering a second metallic precursor setting layer 40 onto the first layer 36' of hollow microspheres 38, locating a contingent of hollow microspheres 38 against the ferrous alloy or nickel alloy component part 16 such that the hollow microspheres 38 contact the second metallic precursor setting layer 40 that overlies the first layer 36', heating and cooling the second metallic precursor setting layer 40 to respectively melt and solidify the setting layer 40 to thereby bond the second layer 36" of hollow microspheres 38 to the first layer 36' of hollow microspheres 38, and finally moving the non-bonded hollow microspheres 38 away from the ferrous alloy or nickel alloy component part 16. These process steps can be repeated as many times as desired to sequentially add and stack additional layers 36 of hollow microspheres 38 onto the second layer 36" until the desired number of layers 36 of hollow microspheres 38 is attained.

The multiple layers 36 of hollow microspheres 38 and the ferrous alloy or nickel alloy component part 16 are then heated as described above to sinter the hollow microspheres 38 in the various layers 36 to each other and to the component part 16, thus fusing those entities together and forming the solid state joint 26, as shown in FIG. 11. That is, the multiple layers 36 of hollow microspheres 38 and the component part 16 may be heated to a temperature below the solidus temperature of the precursor setting layers 40 for a period of time at least until the precursor setting layers 40 integrate and dissolve into the outer layer 46 of hollow microspheres 38 and the ferrous alloy or nickel alloy component part 16 by way of solid-state particle diffusion. And, like before, there are several ways to effectuate sintering, including heating the layers 36 of microspheres 38 and the component part 16 in an oven or furnace, with or without disposing a layer of ceramic particles or some other suitable material over the layers 36 of hollow microspheres 38 as a support mechanism.

Regardless of whether the insulating layer 12 includes a single layer 18 of hollow microspheres 20 or multiple layers 18 of hollow microspheres 20, the gas-impermeable sealing layer 24 is applied over insulating layer 12 to complete the formation of the thermal barrier coating 10 on the ferrous alloy or nickel alloy component part 16. The sealing layer 24, as discussed above, is typically 1 μm to 20 μm thick and is preferably composed of nickel, stainless steel, a nickel-based superalloy (e.g., Inconel, Hastelloy, etc.), vanadium, molybdenum, or titanium. Such materials may be applied onto the insulating layer 12 by a variety of thin-film deposition techniques including electroplating and physical or chemical vapor deposition. The sealing layer 24 may also be thin-film deposited separate from the insulating layer 12 and then subsequently laid onto the insulating layer 12 and heated to secure it in place. Still further, the sealing layer 24 may be separately thin-film deposited and then laid onto the one or more layers 36 of hollow microspheres 38 prior to sintering. In this way, the heating of the one or more layers 36 of hollow microspheres 38 and the ferrous alloy or nickel alloy component part 16 to sinter those entities together also serves to heat the sealing layer and secure it in place to the underlying insulating layer 12. The gas-impermeable sealing layer 24 may be a single thin-film deposited layer or it may be a combination of multiple thin-film deposited layers of the same or differing compositions.

The above description of preferred exemplary embodiments and specific examples are merely descriptive in nature; they are not intended to limit the scope of the claims that follow. Each of the terms used in the appended claims should be given its ordinary and customary meaning unless specifically and unambiguously stated otherwise in the specification.

The invention claimed is:

1. A method of forming a thermal barrier coating on a metal component part, the method comprising:

adhering a metallic precursor setting layer onto a surface of a ferrous alloy or nickel alloy component part, the metallic precursor setting layer being copper, a copper alloy, or a nickel alloy;

locating hollow microspheres against the ferrous alloy or nickel alloy component part so that the hollow microspheres contact the metallic precursor setting layer, the hollow microspheres having an outer layer of nickel, a nickel alloy, iron, or an iron alloy;

heating the metallic precursor setting layer to a temperature above the liquidus temperature of the metallic precursor setting layer to melt the metallic precursor setting layer and wet a layer of hollow microspheres located adjacent to the surface of the ferrous alloy or nickel alloy component part;

cooling the metallic precursor setting layer to a temperature below the solidus temperature of the metallic precursor setting layer to solidify the metallic precursor setting layer and bond the layer of hollow microspheres to the surface of the ferrous alloy or nickel alloy component part;

moving hollow microspheres that are not bonded by the metallic precursor setting layer away from the ferrous alloy or nickel alloy component part; and heating the ferrous alloy or nickel alloy component part and the layer of hollow microspheres bonded to the surface of the ferrous alloy or nickel alloy component part to sinter the hollow microspheres to each other and to the surface of the ferrous alloy or nickel alloy component part such that a solid state joint is formed between the layer of hollow microspheres and the surface of the ferrous alloy or nickel alloy component part.

2. The method set forth in claim 1, wherein at least some of the hollow microspheres include a hollow glass base wall coated externally with a layer of nickel, a nickel alloy, iron, or an iron alloy.

3. The method set forth in claim 1, wherein at least some of the hollow microspheres include a hollow polymeric base wall coated externally with a layer of nickel, a nickel alloy, iron, or an iron alloy.

4. The method set forth in claim 1, wherein at least some of the hollow microspheres include a hollow ceramic base wall coated externally with a layer of nickel, a nickel alloy, iron, or an iron alloy.

5. The method set forth in claim 1, wherein heating the ferrous alloy or nickel alloy component part and the layer of hollow microspheres to sinter the hollow microspheres to each other and to the surface of the ferrous alloy or nickel alloy component part comprises:

heating the layer of hollow microspheres and the surface of the ferrous alloy or nickel alloy component part to a temperature below the solidus temperature of the metallic precursor setting layer for a period of time at least until the metallic precursor setting layer dissolves into the outer layer of the hollow microspheres and the ferrous alloy or nickel alloy component part.

6. The method set forth in claim 1, wherein, prior to heating the ferrous alloy or nickel alloy component part and the layer of hollow microspheres to sinter the hollow microspheres to each other and to the surface of the ferrous alloy or nickel alloy component part, the method further comprises:

(a) adhering a second metallic precursor setting layer onto the layer of hollow microspheres bonded to the surface of the ferrous alloy or nickel alloy component part, the second metallic precursor setting layer being copper, a copper alloy, or a nickel alloy;

(b) locating hollow microspheres against the ferrous alloy or nickel alloy component part so that the hollow microspheres contact the second metallic precursor setting layer overlying the layer of hollow microspheres bonded to the surface of the ferrous alloy or nickel alloy component part, the hollow microspheres having an outer layer of nickel, a nickel alloy, iron, or an iron alloy;

(c) heating the second metallic precursor setting layer to a temperature above the liquidus temperature of the second metallic precursor setting layer to melt the second metallic precursor setting layer and wet a second layer of hollow microspheres located adjacent to the layer of hollow microspheres bonded to the surface of the ferrous alloy or nickel alloy component part;

(d) cooling the second metallic precursor setting layer to a temperature below the solidus temperature of the second metallic precursor setting layer to solidify the second metallic precursor setting layer and bond the second layer of hollow microspheres to the layer of hollow microspheres bonded to the surface of the ferrous alloy or nickel alloy component part; and (e) moving hollow microspheres that are not bonded by the second metallic precursor setting layer away from the ferrous alloy or nickel alloy component part.

7. The method set forth in claim 6, further comprising:

repeating steps (a) to (e) to sequentially deposit additional layers of hollow microspheres on top of the second layer of hollow microspheres.

8. The method set forth in claim 7, wherein heating the ferrous alloy or nickel alloy component part and the layer of hollow microspheres to sinter the hollow microspheres to each other and to the surface of the ferrous alloy or nickel alloy component part includes sintering all of the sequentially applied layers of hollow microspheres together and to the surface of the ferrous alloy or nickel alloy component part.

9. The method set forth in claim 1, wherein the metallic precursor setting layer has a thickness that ranges from 0.1 μm to 20 μm.

10. The method set forth in claim 1, wherein the metallic precursor setting layer is copper.

11. The method set forth in claim 10, wherein heating the metallic precursor setting layer to above the liquidus temperature comprises heating the metallic precursor setting layer to above 1085° C., wherein cooling the metallic precursor setting layer to below the solidus temperature comprises cooling the metallic precursor setting layer to below 1085° C., and wherein heating the ferrous alloy or nickel alloy component part and the layer of hollow microspheres to sinter the hollow microspheres to each other and to the surface of the ferrous alloy or nickel alloy component part comprises heating the layer of hollow microspheres and the ferrous alloy or nickel alloy component part to a temperature in the range of 800° C. and 1085° C.

12. The method set forth in claim 1, wherein the ferrous alloy or nickel alloy component part is an engine piston, an intake valve, an exhaust valve, an engine block, an engine head, an exhaust gas pipe, or a turbocharger housing.

13. A method of forming a thermal barrier coating on a metal component part, the method comprising:

depositing one or more layers of hollow microspheres onto a surface of a ferrous alloy or nickel alloy component part, the hollow microspheres of each of the one or more layers having an outer layer of nickel, a nickel alloy, iron, or an iron alloy, and wherein each of the one or more layers of hollow microspheres is bonded to either the surface of the ferrous alloy or nickel alloy component part or to a previously deposited layer of hollow microspheres by a metallic precursor setting layer of copper, a copper alloy, or a nickel alloy;

heating the one or more layers of hollow microspheres and the ferrous alloy or nickel alloy component part to sinter the hollow microspheres to each other and to the surface of the ferrous alloy or nickel alloy component part to thereby produce an insulating layer; and applying a gas-impermeable sealing layer over the insulating layer to form a thermal barrier coating over the surface of the ferrous alloy or nickel alloy component part, wherein the gas-impermeable sealing layer is composed of nickel, stainless steel, a nickel-based superalloy, vanadium, molybdenum, or titanium.

14. The method set forth in claim 13, wherein depositing a first layer of hollow microspheres onto the surface of the ferrous alloy or nickel alloy component part comprises:

adhering a metallic precursor setting layer onto the surface of the ferrous alloy or nickel alloy component part;

placing hollow microspheres in contact with the metallic precursor setting layer;

heating the metallic precursor setting layer to a temperature above the liquidus temperature of the precursor setting layer to melt the precursor setting layer and wet a layer of hollow microspheres;

cooling the precursor setting layer to a temperature below the solidus temperature of the precursor setting layer to solidify the precursor setting layer and bond the layer of hollow microspheres to the surface of the ferrous alloy or nickel alloy component part; and moving hollow microspheres that are not bonded by the metallic precursor setting layer away from the ferrous alloy or nickel alloy component part.

15. The method set forth in claim 14, wherein depositing each additional layer of hollow microspheres comprises:

adhering another metallic precursor setting layer onto a previously deposited layer of hollow microspheres;

placing hollow microspheres in contact with the another metallic precursor setting layer;

heating the another metallic precursor setting layer to a temperature above the liquidus temperature of the another metallic precursor setting layer to melt the another metallic precursor setting layer and wet another layer of hollow microspheres located adjacent to the previously deposited layer of hollow microspheres;

cooling the another metallic precursor setting layer to a temperature below the solidus temperature of the another metallic precursor setting layer to solidify the another metallic precursor setting layer and bond the another layer of hollow microspheres to the previously deposited layer of hollow microspheres; and moving hollow microspheres that are not bonded by the another metallic precursor setting layer away from the ferrous alloy or nickel alloy component part.

16. The method set forth in claim 13, wherein the hollow microspheres in each of the one or more layers of hollow microspheres comprise (1) glass base walls coated externally with a layer of nickel, a nickel alloy, iron, or an iron alloy, (2) polymeric base walls coated externally with a layer of nickel, a nickel alloy, iron, or an iron alloy, or (3) ceramic base walls coated externally with a layer of nickel, a nickel alloy, iron, or an iron alloy.

17. The method set forth in claim 13, wherein the metallic precursor setting layer that bonds each layer of hollow microspheres to either the surface of the ferrous alloy or nickel alloy component part or to a previously applied layer of hollow microspheres is composed of copper.

18. The method set forth in claim 17, wherein heating the ferrous alloy or nickel alloy component part and the one or more layers of hollow microspheres to sinter the hollow microspheres to each other and to the surface of the ferrous alloy or nickel alloy component part comprises:

heating the ferrous alloy or nickel alloy component part and the one or more layers of hollow microspheres to a temperature in the range of 800° C. and 1085° C.

19. The method set forth in claim 13, wherein the insulating layer comprising the one or more layers of hollow microspheres has a thickness that ranges from 5 μm to 5 mm.

* * * * *